United States Patent [19]

Nichols

[11] Patent Number: 4,890,407

[45] Date of Patent: Jan. 2, 1990

[54] DOVETAIL GUN SIGHT MOUNT

[76] Inventor: Joseph W. Nichols, P.O. Box 23, Mehoopany, Pa. 18629

[21] Appl. No.: 219,082

[22] Filed: Jul. 13, 1988

[51] Int. Cl.[4] ..... F41G 1/38

[52] U.S. Cl. ..... 42/100; 42/103; 33/245; 33/233

[58] Field of Search ..... 42/100, 101, 103; 33/245, 250, 233

[56] References Cited

U.S. PATENT DOCUMENTS

| | | | |
|---|---|---|---|
| 3,424,420 | 1/1969 | Seiderman | 42/101 |
| 3,992,783 | 11/1976 | Dunlap et al. | 42/103 |
| 4,008,536 | 2/1977 | Adams | 42/100 |
| 4,021,954 | 5/1977 | Crawford | 42/101 |
| 4,026,055 | 5/1977 | Weast | 42/101 |
| 4,383,371 | 5/1983 | Coffey | 42/101 |
| 4,429,468 | 2/1984 | Jimenez et al. | 33/245 |

*Primary Examiner*—Deborah L. Kyle
*Assistant Examiner*—Michael J. Carone
*Attorney, Agent, or Firm*—Seed and Berry

[57] ABSTRACT

A two-piece dovetail mount for a firearm formed with a vertical centerline split. The mount includes first and second members that are fastened together by threaded fasteners. The upper region of the mount forms an industry standard dovetail mount for a sight. The lower region of the mount provides a clamping region for holding the mount onto the firearm. The two members of the mount contact the firearm at the lower region and contact each other at the upper region when being fastened together by the threaded fasteners to define a downwardly opening gap therebetween. When the mount is tightly clamped onto the firearm, the gap remains between the two members at the bottom region, just above the firearm. The gap ensures that an adequate clamping force is applied to hold the mount onto the firearm and permits the mount to be further tightened after the firearm has been fired a number of times. The gap also provides an airflow channel to promote cooling of the mount and firearm, and accommodates differences in the coefficients of thermal expansion between the firearm and the mount. The mount includes an integral recoil absorbing mass abutting a rearward portion of the receiver of the firearm to transfer the recoil force into the mount.

17 Claims, 2 Drawing Sheets

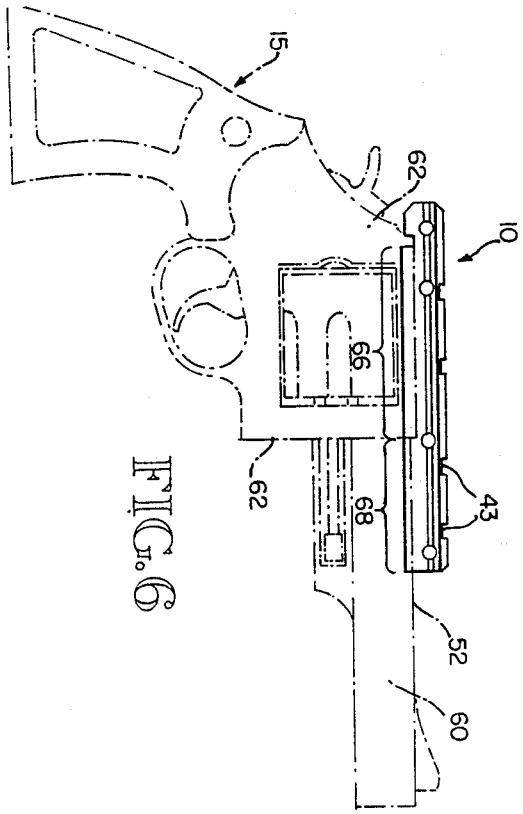
FIG. 6
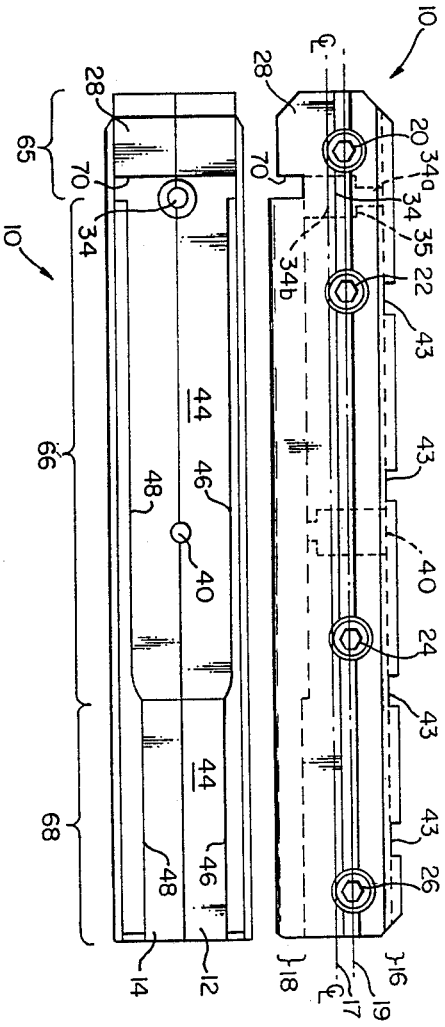
FIG. 1
FIG. 2
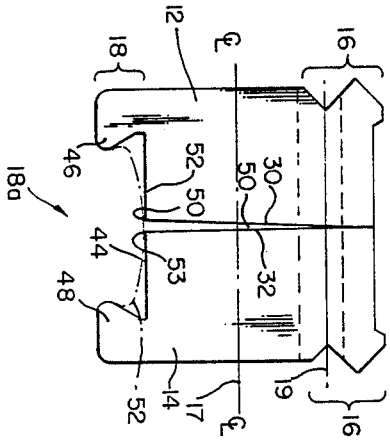
FIG. 3

DOVETAIL GUN SIGHT MOUNT

TECHNICAL FIELD

This invention relates to mounts for gun sights.

BACKGROUND OF THE INVENTION

Sights for firearms are mounted on guns using various mounting assemblies. One assembly in use today for holding a sight on a firearm is a dovetail mount. The dovetail mount is usually formed in one or more industry standard sizes, and most gun sight mounts are formed with a corresponding dovetail groove to fit the industry standard dovetail mount for the firearm.

The dovetail mount for the sight must be properly and firmly attached to the firearm to ensure that the sight remains firmly attached to the firearm even after many rounds have been fired. One technique presently in use for attaching a dovetail mount to a rifle is to couple the mount to the firearm using threaded fasteners screwed into the firearm itself. This requires that holes be drilled and tapped into the firearm, usually into the barrel or into the receiver or both, for receiving the threaded fasteners. The mount is then secured to the firearm using fasteners extending through the mount and into the firearm. One disadvantage of this technique is that the mount must be precision made for each gun to ensure a proper fit. A further disadvantage is that a gunsmith or similarly skilled person must attach the mount to the firearm, as the procedure requires precision tools and training and a machining operation. An improperly attached mount may come off the firearm while firing a round, thus causing injury. A further reason that a gunsmith is required is that the holes drilled and tapped into the firearm must be precisely formed to ensure that the holes do not extend into or near the interior or the barrel or firing chamber. Holes of improper depth or improperly positioned increase the likelihood of injury and destroy the firearm beyond repair. Of course, the firearm owner usually would prefer not to drill holes into his firearm since it adversely affects its appearance when the firearm is used without the sight and the resale value of the firearm alone.

Properly attaching a dovetail mount to a handgun has, in the past, been extremely difficult or impossible. The techniques used by a gunsmith to attach the sight mount to a rifle are very difficult or impossible to apply when attaching the mount to a handgun. The handgun has much less mass to absorb the recoil of firing a round and generally has less area available for attaching a mount. As a result, many of the sights used on rifles cannot be used on handguns. Even if a mount is attached to a handgun, it must be precisely machined and prepared for each handgun to ensure a proper fit. This results in the mount being so expensive compared to the cost of the handgun that the mount is not economical to attach.

SUMMARY OF THE INVENTION

It is therefore an object of this invention to provide a two-member vertical split dovetail mount that can be attached to a firearm without special tools or training.

It is an object of this invention to provide a dovetail mount for attaching to a handgun.

It is another object of this invention to provide a method of securely attaching a dovetail mount to a handgun.

It is another object of this invention to provide a sight mount that may be tightened after many rounds have been fired by clamping one mount member to another mount member.

It is another object of this invention to provides a gap in the mount to enhance cooling and provide a space for thermal expansion of the mount and the firearm.

These and other objects of the invention, as described herein, are accomplished by providing a two-member, dovetail sight mount. The two members are attached to each other using threaded fasteners. The threaded fasteners are located above the horizontal center line of the mount. This permits the two members to be clamped closer together at a top region than at a bottom region. A gap is left at the bottom region, just above the firearm. This ensures that the clamping force is applied as a gripping force to hold the mount to the firearm. The gap also provides an expansion space during heating of the mount due to firing. The gap also provides a large surface area for airflow cooling of the mount and the firearm. The gap is large enough that the threaded fasteners may be still further tightened after the firearm has been fired to ensure that a tight fit can be achieved at all times and not just on the initial mounting.

BRIEF DESCRIPTION OF THE DRAWINGS

FIG. 1 is a side elevational view of the assembled mount of the present invention.

FIG. 2 is a bottom plan view of the mount shown of FIG. 1.

FIG. 3 is a front elevational view of the mount shown attached to a firearm, illustrated in phantom line.

FIG. 6 is a side elevational view of the mount of FIG. 1 shown mounted on a firearm.

DETAILED DESCRIPTION OF THE INVENTION

Figure 7:
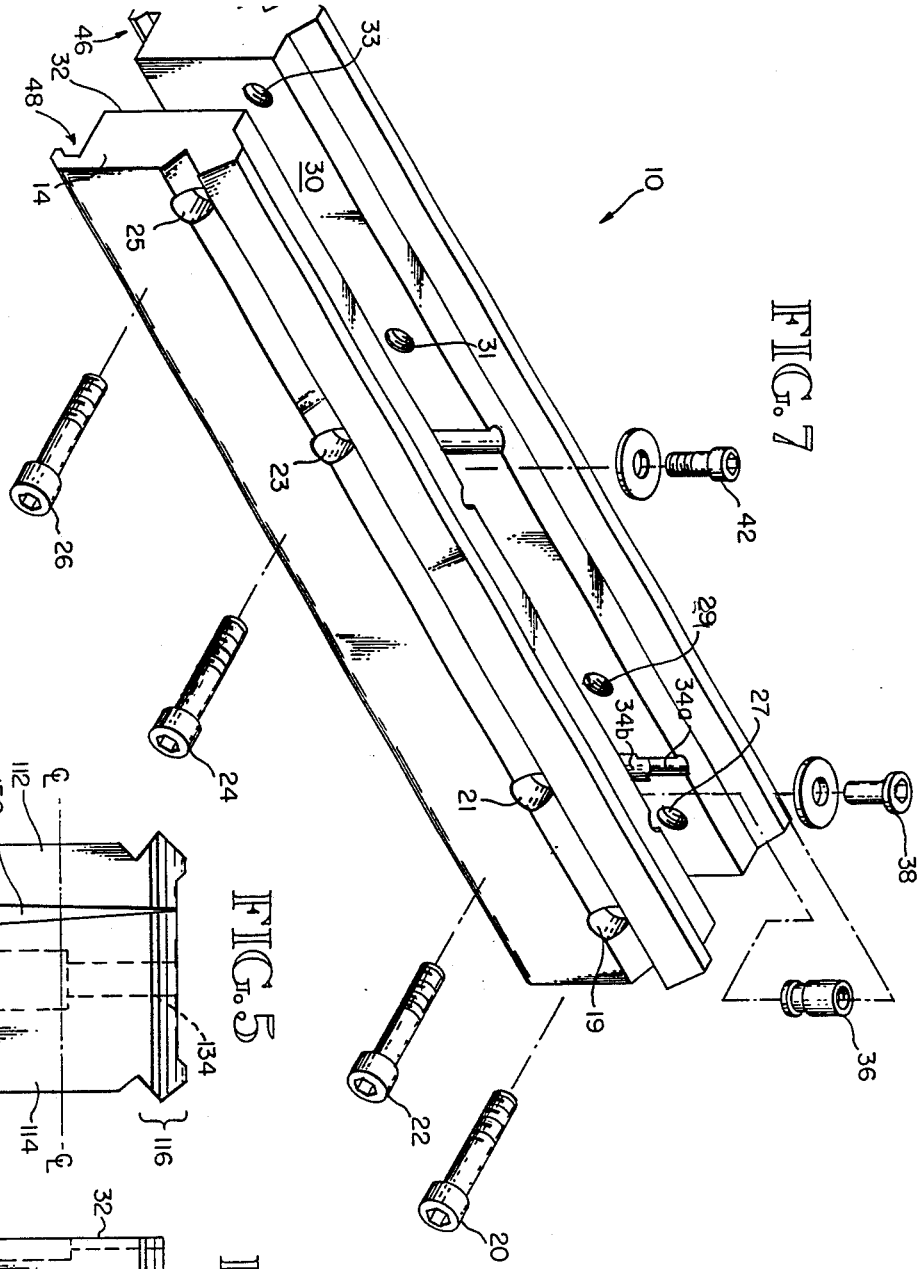
FIG. 7 is an enlarged isometric, exploded view of the mount of FIG. 1.

The dovetail sight mount, designated generally as 10, includes an elongated right side member 12 and an elongated left side member 14, as shown in FIGS. 1 and 2. The mount includes a sight mounting region 16 at the top, formed with the industry standard dovetail shape, as shown in FIG. 3 for mounting an electronic or telescopic sight thereto. The sight mount also includes a clamping region 18 at the bottom. The interior surface **18*a* of the clamping region is shaped according to the firearm on which the mount is to be attached to provide a mating dovetail joint member. A plurality of smooth bore holes 19, 21, 23 and 25 are provided for threaded fasteners 20, 22, 24 and 26, respectively, to pass through the left side member 14, as shown in FIG. 7. A plurality of corresponding threaded holes 27, 29, 31 and 33 are provided in member 12 for receiving the fasteners to fasten the right side member 12 to the left side member 14. The center of the holes is positioned above a horizontal center plane 17 of the mount when assembled, as shown by the phantom center plane 17 in FIGS. 1 and 3**.

The mount includes a recoil absorbing mass 28, as shown in FIGS. 1 and 2. The mount includes a bore through-hole 34 having an upper portion 34*a* and an enlarged lower chamber portion 34*b* with an interior shoulder 35 therebetween. A rear thrust piston 36 is positioned in the lower chamber portion 34*b* and, in one embodiment of the invention, a rear thrust piston screw 38 extends through the upper portion 34*a* and screws into the thrust piston 36, shown in FIG. 7 and described below. A smooth bore through-hole 40 is provided in the mount toward its longitudinal center for receiving a strap screw 42. The cylindrical holes 34 and 40 are formed by fastening members 12 and 14 together, each having respective half-cylindrical slots therein which align with each other when the mount is assembled. A plurality of transverse slots 43 may be provided in the top of the dovetail mount if desired, as shown in FIG. 1, to receive therein the clamping bars for mounting rings of the sight (not shown) to be mounted to the sight mount 10.

Figure 4:
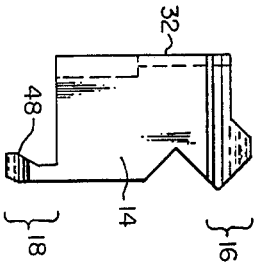
FIG. 4 is a front elevational view of one member comprising the mount of FIG. 1.

Member 12 includes an interior, lengthwise extending wall 30; and member 14 includes an interior, lengthwise extending wall 32, as shown in FIGS. 3, 4 and 7. The interior walls 30 and 32 are flat and substantially vertically oriented when the mount 10 is in position on a firearm. The mount includes a bottom surface 44, which contacts a top surface 52 of a firearm 15 to which it is mounted. The clamping region 18 of the mount includes opposed right and left side gripping arms 46 and 48, shown in FIGS. 2 and 7, which extend lengthwise along members 12 and 14. The arm 46 and 48 grip the sides of the top of the firearm dovetail mounting portion when the mount is placed on the firearm, as best shown in FIG. 3. A rearward, lengthwise portion 65 of the members has no gripping arms.

The mount 10 is attached to the firearm 15, as shown for a handgun in FIGS. 3 and 6. The firearm includes a barrel 60 and a receiver 62. The bottom surface 44 and the gripping arms 46 and 48 of the mount are machined and shaped to conform to the shape and size of the top portion and sides of the receiver and the barrel. The lengthwise portion 66 of the mount is positioned above the receiver 62, and the lengthwise portion 68 of the mount is positioned above the barrel 60, as shown in FIG. 6. The bottom region 44 and gripping arms 46 and 48 follow the contour of the firearm along their entire length. The threaded fasteners 20, 22, 24 and 26 extend through respective smooth bore holes 19, 21, 23 and 25 of the member 14 and into the threaded holes 27, 29, 31 and 33 of the member 12. When the mount 10 is positioned on the firearm 15, tightening the threaded fasteners 20, 22, 24 and 26 firmly holds the two members together and clamps them onto the firearm. The interior walls 30 and 32 of two members 12 and 14 contact each other along their length, at a location toward the top region 16, to form an industry standard size dovetail mount for a sight thereto.

The recoil absorbing mass 28 is positioned directly behind and abutting a rearward end portion of the receiver 62 of the firearm. The recoil absorbing mass includes a downwardly projecting surface portion 70 that firmly abuts the receiver end portion. When the firearm 15 is fired, the recoil force, or kick, is applied directly to the recoil absorbing mass 28 through surface portion 70. This provides a number of advantages. One is a result of the fact that the recoil mass 28 is an integral part of the mount 10 and the mount moves as a whole with the recoil absorbing mass. The recoil force from the firearm is transferred, either completely or partially, to the mount through the mass 28 rather than solely through gripping arms 46 and 48 and the threads of the fasteners 20, 22, 24 and 26. Further, the recoil absorbing mass 28 absorbs some of the recoil force, thus reducing the recoil force transferred to the fasteners. This reduces the stress on the threaded fasteners. The result is that the mount 10 remains firmly attached to the firearm, even after many rounds have been fired. When a mount is attached to the firearm using the prior art method of having threaded fasteners extend into the firearm, the recoil force is transferred solely through the threads of the fasteners. Each round that is fired places stress on the fastener threads and the threads in the tapped hole in the gun barrel. This results in the threads having to absorb and transfer the recoil force. In some firearms, this can be a significant force. This shortens the life of the barrel, threads and the mount. It also requires more regular retightening of the fasteners.

The chamber portion 34*b* of the bore hole 34, which receives the rear thrust piston 36, is formed from two portions of the hole from members 12 and 14, as shown in FIG. 7. The rear thrust piston 36 and a rear thrust piston screw 38 are used together. The screw 38 extends through the bore hole top chamber 34 and into the thrust piston 36 to hold it in place and ensure that the recoil force which is transferred from the gun and into the mount places minimum stress on the fasteners which clamp the mount onto the firearm.

Many handguns have either a slot or ridge formed just forward of the end of the receiver in the top surface 52 of the firearm. For example, the rear sight slot may be used as the slot into which the rear thrust piston is placed. The rear thrust piston 36 is shaped to enter the slot or abut against the ridge, whichever is present, and firmly engage the receiver and the mount. The rear thrust piston 36 provides additional mass and surface area to absorb the recoil and to transfer the recoil force to the mount through a surface other than the gripping surface 18*a*. This aids to ensure that the mount and the firearm move together as a unit immediately after a round is fired, similar to the function provided by recoil mass 28.

Most handguns include, as built by the manufacturer, a tapped hole for a rear anchor screw (not shown). In the event the proper sot or ridge is not provided, the rear thrust piston 36 may be threaded into this hole. The rear thrust screw 38 is then threaded into the piston 36 to hold it in place to perform the same function as previously described above.

The strap screw 42 aids the user in pacing the mount 10 on the firearm 15. Strap screw 42 may be used if desired but is not required. Many firearms have a hole in a certain position for receiving a threaded fastener, such as a strap screw. Placing the strap screw 42 through the mount and into the hole in the receiver ensures that the mount is properly positioned on the firearm and that the proper mount has been provided for that firearm. After the mount is completely assembled, attached, and each of the fasteners 20, 22, 24 and 26 are torqued the correct amount, the strap screw 42 may be removed, if desired, as it is not necessary to firmly attach the mount to the firearm.

The two members 12 and 14 contact the firearm 15 at the bottom by the gripping arms 46 and 48 prior to the interior walls 30 and 32 contacting each other at locations toward the clamping region 18 to define a gap 50 therebetween, as shown in FIG. 3. This is because the total width of the members 12 and 14 when placed together is slightly less than the total width of the top portion of the firearm to which the mount is to be clamped. This leaves the gap 50 between the members 12 and 14 immediately above the firearm 15.

As described above, when the threaded fasteners 20, 22, 24 and 26 are tightened, the interior walls 30 and 32 are brought into contact with each other at the top region 16 but not at the bottom region 18. The interior walls near the clamping region 18 firmly grip the gun 15 and leave the gap 50 when the fasteners are torqued a predetermined amount. The gap 50 ensures that the clamping force is applied by the fasteners 20, 22, 24 and 26 to hold the mount 10 on the firearm rather than to merely fasten member 12 to member 14.

The fasteners are positioned to ensure that the top region forms an industry standard dovetail mount while, at the same time, providing a gripping force at the bottom region. The center plane 19 of the threaded fasteners is positioned, in one embodiment, above the horizontal center plane 17 of the mount. This permits the top region to act as a pivot point of a lever arm, with the fasteners providing a clamping force at the bottom region. The horizontal center plane 19 of the fasteners need only be sightly above the horizontal center pane 17 of the mount to provide the desired clamping force and gap 50. In one embodiment (not shown), the bottoms of the fasteners 20, 22, 24 and 26 are aligned with the center plane and the, center plane of the fasteners is above the center plane of the mount by half the height of the fasteners. In another embodiment, such as shown in FIG. 1, the entire hole is spaced above the center plane 17. Alternatively, the fasteners may be positioned below the center plane 17. The portion of the fasteners' gripping force applied to the top region 16 versus that portion applied to the bottom region 18 will vary, depending on the vertical position of the horizontal plane 19 of the threaded fasteners with respect to the mount's center plane 17. In an alternative embodiment (not shown), a set of fastener holes, with corresponding threaded fasteners may be placed in the mount below the center plane 17 in addition to the fasteners provided above the center plane 17. This will increase the clamping force and thus the gripping force in the bottom region 18.

The mount 10 is preferably made of aluminum, which means it has a different coefficient of thermal expansion than the high-quality steel of the firearm 15 to which it is mounted. The threaded fasteners 20, 22, 24 and 26 are also made of a high-quality steel having a different coefficient of thermal expansion than aluminum. The aluminum will generally expand more than the steel due to heating while firing a round, which causes the fasteners and mount to work loose over time after repeated firing. This is caused, at least in part, by the resulting repeated heating and cooling of the mount and the differences of thermal expansion between the aluminum mount, the threaded fasteners and the firearm. The advantage of providing the gap 50 is that later tightening is possible to increase or renew the gripping force of the mount. The gap 50 is made large enough to permit later tightening of the fasteners to provide the desired gripping force.

The gap 50 also provides an expansion space for the aluminum to expand into as it heats up. This expansion may be relatively small; but by providing gap 50, additional stresses that would otherwise occur between the firearm and the mount, between the two members 12 and 14 comprising the mount, and between the threaded fasteners and the mount are avoided.

A further problem with aluminum realized over time is that it may "flow" or thin out when significant pressure is applied. In the prior art techniques used to attach mounts using holes tapped into the firearm, the "flowing" of aluminum over time causes significant problems. While the fasteners of the prior art may later be tightened, the holes must be drilled and tapped deep enough into the firearm to provide additional tightening thorough the life of the mount. This increases the likelihood that the tapped hole will enter the barre) bore or leave an impermissible thin layer of metal in the barrel region, creating significant safety hazards. With the present invention, the clamping force that holds the mount onto the firearm is provided by two members of the mount being attached to each other. No tapping into the firearm is required as a holding force to retain the mount on the firearm. As more gripping force is required, as may occur due to aluminum "flow" problems or the coefficient of thermal expansion problems, the additional gripping is provided across the mount by clamping the member 12 tighter to the member 14.

The mount 10 is generally attached over the hottest part of the firearm 15. The firing chamber and barrel portion just forward of the firing chamber experience a significant temperature rise when rounds are fired. The temperature rise may be particularly significant if many rounds are rapidly fired. Providing gap 50 over the barrel 60 permits faster and more efficient cooling of the firearm and the mount since air circulates through the gap 50, providing additional cooling. The exposed surface areas of the top surface 52 of the firearm and the exposed portions of the interior walls 30 and 32 of the mount provide a larger surface area for heat dissipation than that provided when gap 50 is not present.

In conventional methods of attaching a mount to a firearm which has the threaded fasteners extend through the mount and into the firearm, the mount is firmly attached to the firearm with no space provided therebetween. Heat is transferred through the mount and often into the sight itself before being dissipated. The excessive heating of the mount and sight further exacerbates problems caused by differences in the coefficient of thermal expansion and shortens the working life of the components. The present invention permits heat dissipation directly from the firearm itself over the hottest part of the firearm, as well as providing the spaced-apart interior walls 30, 32 and 44, which effectively serve as fin surface areas to dissipate heat.

After many rounds have been fired, the mount may have moved slightly on the firearm or be loose. This generally occurs because of the reasons described above, such as repeated recoils of the firearm; repeated heating and cooling of the firearm, mount and threaded fasteners; and flow of the aluminum. The mount may also become loose due to constant contact between two different types of metal, aluminum and steel. The fasteners 20, 22, 24 and 26 may be tightened after firing many rounds to provide renewed gripping force of the mount to the firearm. This second tightening may reduce the size of gap 50 somewhat, but the gap is sized sufficiently large to allow repeated tightenings. The existence of a gap 50 immediately above the gripping arms 46 and 48 ensures that the clamping force is being applied to hold the mount onto the firearm, even if the gap 50 should become very small. The mount is designed with the gap 50 initially large enough to permit the fasteners to be tightened as necessary over the life of the sight and firearm.

The bottom surface 44 and gripping arms 46 and 48 are custom-machined to fit a particular firearm. For example, the shape and position of the gripping regions may be different for a Ruger, Smith and Wesson, Colt Python, Colt Diamondback, or other firearm. One advantage of the construction of this mount is that the tolerances are not as tight as required in other mounts. The members 12 and 14 are made the proper size to ensure that a gap 50 exists; however, the exact dimensions of that gap are not critical. The tolerances of the widths, gripping regions and bottom portion can be somewhat less tight than required in other mounts because the differences are accommodated for by the gap 50. Considerable time and money savings in construction of the mount result by requiring less rigorous tolerances for parts. Further, the same bottom surface 44, and hence mount, may be used for several different brands of firearms because they are similar enough to each other within the required tolerances.

Figure 5:
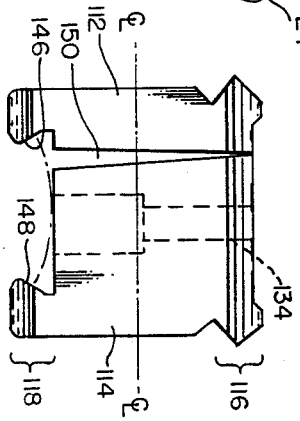
FIG. 5 is a front elevational view of an alternative embodiment of the mount.

An alternative embodiment of the mount 10, having members 112 and 114, is shown in FIG. 5. The two mount members are similar in function and operation to mount members 12 and 14 but are shaped differently. The left side member 114, or alternatively, the right side member 112, is made much wider than the other member. The total combined width of the members is still less than the width of the top of the firearm, thus leaving a gap 150 having the same advantages and functions as gap 50. An advantage of the alternative embodiment is that a through-hole 134 provided for a rear thrust piston (not shown) is formed in a single member 114 rather than by the union of cavities in two members, such as is hole 34 in members 12 and 14. The gripping force to hold the mount to the firearm is provided as a clamping force through members 114 and 112, as previously described with respect to members 14 and 12. The embodiment of FIG. 5 is similar in attachment, use and advantages to the embodiment of FIGS. 1, 3 and 7.

The mount of the present invention may be completely assembled, attached and serviced by the firearm owner, and does not require the assistance of a gunsmith. The method of assembling and attaching the mount is as follows. The two members 12 and 14 are loosely fastened together using threaded fasteners 20, 22, 24 and 26. The rear thrust piston 36 is placed in the proper position on the firearm, such as in the rear sight slot. The mount is placed on the firearm with the rear thrust piston 36 entering the chamber portion **34*b* of the hole 34 from the bottom as the mount is placed on the firearm. The mount is seated forward of the rear sight notch, with the recoil mass 28 behind the receiver and abutting the receiver. Alternatively, one member, such as member 12, may be held in position on the firearm, the rear thrust piston placed in the slot and then the other member 14 placed on the firearm. The threaded fasteners are then placed through the members to hold them together. The rear thrust piston 36 is held in hole 34 by the shoulder 35 in hole 34 and does not fall out. Strap screw 42 may be placed through the hole 40 in the mount and threaded into the firearm to ensure that the mount is properly positioned on the firearm. After the threaded fasteners are then tightened to a specified torque, the mount is ready for use. The strap screw 42 may be removed, if desired. A sight may be attached to the dovetail mount provided at the top region 16 of the mount. After many rounds have been fired, the fasteners 20, 22, 24 and 26** may be retorqued, if necessary.

The mount and method of attaching and using the mount have been described with respect to particular embodiments; however, it will be understood that variations from the embodiments shown are possible. Any equivalent members or means can be used in place of those described.

I claim:

1. A sight mount for a firearm, comprising:

an elongated first member;

an elongated second member;

fastening means for adjustably fastening said first member to said second member to form said mount, when fastened together said first and second members defining a dovetail sight mount at a top region thereof and defining a clamping attachment portion at a bottom region thereof, said clamping attachment portion being sized to receive a portion of the firearm and clamp the mount thereto; and a rear thrust member extending through said mount and contacting the firearm.

2. The mount according to claim 1 for use with a firearm having a slot, wherein said rear thrust member is held in position by a retaining shoulder in said mount and the slot in the firearm.

3. The mount of claim 1 wherein said fastening means includes a plurality of screws.

4. The mount of claim 1 wherein said fastening means applies a force for fastening said first member to said second member in a plane above a horizontal center plane of said mount.

5. The mount according to claim 1 wherein said first and said second members define a gap therebetween, with an opening extending at least partially along the length of said first and second members and opening toward the firearm.

6. The mount according to claim 5 wherein said gap is positionable at least in part to extend along a barrel portion of the firearm and is sized to permit circulation therethrough of air from around said first and second members at said bottom region and a top region of the barrel over which the mount is clamped for cooling the mount and the firearm.

7. The mount according to claim 1 for use with a firearm having a receiver, wherein said first and second members include at said bottom region a lengthwise mass portion adapted to abut the receiver.

8. The sight mount according to claim 1 wherein said firearm is a handgun.

9. A sight mount for a firearm having a receiver, comprising:

an elongated first member;

an elongated second member; and fastening means for adjustably fastening said first member to said second member to form said mount, when fastened together said first and second members defining a dovetail sight mount at a top region thereof and defining a clamping attachment portion at a bottom region thereof, said clamping attachment portion being sized to receive a portion of the firearm and clamp the mount thereto, wherein said first and second members have a mass portion formed integrally with said members at the rear of the mount and abutting the receiver of the firearm, said mass portion having sufficient mass to absorb a substantial portion of the recoil of the firearm.

10. A mount for a firearm, comprising:

a dovetail mount formed by the union of elongated first and second members, said first and second members being coupled together by threaded fasteners having their axes positioned above a horizontal center line of said mount, said members having a clamping attachment portion along a bottom region of the mount, the combined width of said members at a bottom region thereof positionable toward the firearm being less than the width of the firearm at the region of attachment, said members defining a downwardly opening gap therebetween along said bottom region of the mount, said gap being sized to permit repeated adjustment of said threaded fasteners to urge said first and second members together into contact along a top region of the mount while said members are in contact with the firearm at the bottom region, said gap being positioned at a location between said first and second members unequally spaced from longitudinally extending exterior sidewall portions of said members.

11. The mount according to claim 10 wherein said gap is oriented vertically and positioned centrally between said first and second members substantially equidistant from a longitudinally extending exterior sidewall portion of each of said members.

12. The mount according to claim 10 wherein said bottom region includes interior gripping regions for gripping the sides of said firearm when said threaded fasteners are tightened.

13. A mount for a firearm, comprising:

a dovetail mount formed by the union of elongated first and second members, said first and second members being coupled together by threaded fasteners having their axes positioned above a horizontal center line of said mount, said members having a clamping attachment portion along a bottom region of the mount, the combined width of said members at a bottom region thereof positionable toward the firearm being less than the width of the firearm at the region of attachment, said members defining a downwardly opening gap therebetween along said bottom region of the mount, said gap being sized to permit repeated adjustment of said threaded fasteners to urge said first and second members together into contact along a top region of the mount while said members are in contact with the firearm at the bottom region wherein said mount includes a bore extending through said mount sized for placing a thrust piston therethrough, said bore extending perpendicular to said fasteners.

14. A mount for a firearm, comprising:

a dovetail mount formed by the union of elongated first and second members, said first and second members being coupled together by threaded fasteners having their axes positioned above a horizontal center line of said mount, said members having a clamping attachment portion along a bottom region of the mount, the combined width of said members at a bottom region thereof positionable toward the firearm being less than the width of the firearm at the region of attachment, said members defining a downwardly opening gap therebetween along said bottom region of the mount, said gap being sized to permit repeated adjustment of said threaded fasteners to urge said first and second members together into contact along a top region of the mount while said members are in contact with the firearm at the bottom region wherein said firearm is a handgun.

15. The method of attaching a mount to a gun, comprising:

loosely coupling a first member to a second member using a threaded fastener in a horizontal plane to form said mount, said threaded fastener being located above a horizontal center plane of said mount;

placing said mount on a firearm;

forming a vertical hole extending through said mount, said hole being formed by the junction of said first and second members;

placing a thrust piston within said hole and contacting said firearm; and tightening said threaded fasteners to a desired torque for coupling said mount to said firearm.

16. The method according to claim 15, further including the steps of:

placing a locating screw through said mount and into said firearm;

tightening said threaded fasteners; and removing said locating screw prior to placing a sight on said mount.

17. The method according to claim 15, further including:

firing said firearm; and tightening said threaded fasteners to ensure that said mount is firmly mounted on said firearm.

* * * * *